US007926278B2

(12) United States Patent
Gerendás et al.

(10) Patent No.: US 7,926,278 B2
(45) Date of Patent: Apr. 19, 2011

(54) GAS-TURBINE COMBUSTION CHAMBER WALL FOR A LEAN-BURNING GAS-TURBINE COMBUSTION CHAMBER

(75) Inventors: Miklós Gerendás, Am Mellensee (DE); Michael Ebel, Rangsdorf (DE)

(73) Assignee: Rolls-Royce Deutschland Ltd & Co KG (DE)

( * ) Notice: Subject to any disclaimer, the term of this patent is extended or adjusted under 35 U.S.C. 154(b) by 967 days.

(21) Appl. No.: 11/808,436

(22) Filed: Jun. 11, 2007

(65) Prior Publication Data

US 2007/0283700 A1 Dec. 13, 2007

(30) Foreign Application Priority Data

Jun. 9, 2006 (DE) ..... 10 2006 026 969

(51) Int. Cl.
*F02C 7/24* (2006.01)

(52) U.S. Cl. ..... 60/725; 60/752

(58) Field of Classification Search ..... 60/725, 60/752–760
See application file for complete search history.

(56) References Cited

U.S. PATENT DOCUMENTS

| | | | | |
|---|---|---|---|---|
| 4,242,871 | A * | 1/1981 | Breton | 60/757 |
| 4,916,906 | A * | 4/1990 | Vogt | 60/757 |
| 5,435,139 | A * | 7/1995 | Pidcock et al. | 60/757 |
| 5,483,794 | A * | 1/1996 | Nicoll et al. | 60/766 |
| 6,260,359 | B1 * | 7/2001 | Monty et al. | 60/752 |
| 6,266,961 | B1 * | 7/2001 | Howell et al. | 60/752 |
| 6,351,947 | B1 * | 3/2002 | Keller et al. | 60/725 |
| 6,397,603 | B1 * | 6/2002 | Edmondson et al. | 60/753 |
| 6,530,221 | B1 * | 3/2003 | Sattinger et al. | 60/725 |
| 6,655,146 | B2 * | 12/2003 | Kutter et al. | 60/752 |
| 6,675,582 | B2 * | 1/2004 | Monty et al. | 60/752 |
| 6,837,051 | B2 * | 1/2005 | Mandai et al. | 60/725 |
| 6,868,675 | B1 * | 3/2005 | Kuhn et al. | 60/772 |
| 6,964,170 | B2 * | 11/2005 | Alkabie | 60/772 |
| 6,981,358 | B2 * | 1/2006 | Bellucci et al. | 60/39.17 |
| 7,007,481 | B2 * | 3/2006 | McMasters | 60/752 |
| 7,086,232 | B2 * | 8/2006 | Moertle et al. | 60/752 |
| 7,334,408 | B2 * | 2/2008 | Bethke et al. | 60/725 |
| 7,549,290 | B2 * | 6/2009 | Holt et al. | 60/725 |
| 7,549,506 | B2 * | 6/2009 | Sattinger | 181/213 |
| 2002/0066272 | A1 | 6/2002 | Suenaga | |

FOREIGN PATENT DOCUMENTS

| | | | |
|---|---|---|---|
| DE | 43 16 475 | A1 | 1/1994 |
| DE | 601 50 531 | T2 | 11/2005 |
| EP | 0 971 172 | A1 | 1/2002 |
| EP | 1 231 435 | A2 | 8/2002 |
| EP | 1 475 567 | A1 | 11/2004 |
| WO | WO 2006/032633 | A1 | 3/2006 |

* cited by examiner

*Primary Examiner* — William H Rodríguez
(74) *Attorney, Agent, or Firm* — Timothy J. Klima; Shuttleworth & Ingersoll, PLC

(57) ABSTRACT

A gas-turbine combustion chamber wall for a lean-burning gas-turbine combustion chamber with a combustion chamber casing 2, 3 and several combustion chamber segments arranged in the combustion chamber casing 2, 3 and forming a combustion chamber wall 10. Each of the combustion chamber segments is supplied with cooling air with film cooling via axial and/or radial cooling holes 16, 17, with the cooling holes 16, 17 being axially spaced from each other and with dampening openings 19*a* being provided in this area for the introduction of cooling air.

20 Claims, 6 Drawing Sheets

(Damper Opening Cross-Sections)

Figure 1:
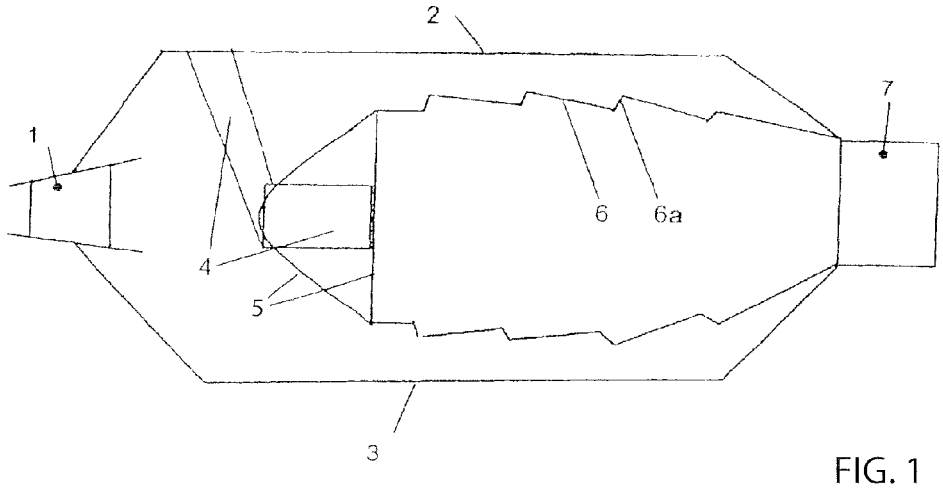
FIG. 1 (Prior Art)

GAS-TURBINE COMBUSTION CHAMBER WALL FOR A LEAN-BURNING GAS-TURBINE COMBUSTION CHAMBER

This application claims priority to German Patent Application DE2006 026 969.1 filed Jun. 9, 2006, the entirety of which is incorporated by reference herein.

This invention relates to a gas-turbine combustion chamber wall for a lean-burning gas-turbine combustion chamber.

UK Patent Specification GB 2 309 296 describes a double-skin wall design of a lean-burning gas-turbine combustion chamber with acoustic dampening effect on high-frequency combustion chamber vibrations (frequency band specified 3 to 9 kHz) and simultaneous cooling of the combustion chamber wall. Both effects are achieved by holes arranged perpendicularly through the wall. The outer/cold combustion chamber wall produces the impingement cooling jets onto the inner/hot wall, while the holes through the inner/hot wall discharge the impingement cooling air into the combustion chamber, producing the dampening effect.

Specification EP 0 576 435 B1 describes a combustion chamber with a double-skin wall design, subdivided into chambers, with all holes being oriented at a shallow angle to the surface, as a result of which no dampening effect is produced.

As a further state of the art, reference is made to EP 971 172 A1 and U.S. Pat. No. 6,907,736 B2.

While film cooling with cooling rings and effusion cooling is available in single-skin design for the cooling of combustion chambers, tiles mounted with studs (provided with pins on the rear side or impingement-cooled) or brazed or welded sheet-metal fabrications, respectively (Transply®, Lamilloy®) are available in multi-skin design. For conventional film cooling, on a cooling-ring basis, the cooling air is provided via holes or slots in the cooling rings, which produce the cooling film with or without deflection. These openings can be arranged essentially radially to provide for supply of the cooling air on the basis of the static pressure of the cooling air supply or essentially axially to provide for supply of the cooling air on the basis of the total pressure of the air supply or, simultaneously, by both methods. In the case of radial openings, a lip is used on the cooling ring upon which the impinging jets are axially deflected. The axial and radial openings can be disposed in one row or in several rows. In the case of multiple rows of openings in axial direction, these are radially staggered and the lip is normally dispensed with.

A suitable dampening effect is only obtainable by openings disposed essentially perpendicularly through the combustion chamber wall. Suppression of combustion vibrations is optimally effected with dampers connected to the combustion chamber in the area of maximum heat release.

With vertical openings, efficient film cooling is obtainable to a very limited extent only. Due to the inadequacy of the cooling effect, the authors of the above-mentioned patent specification confine the scope of application of the dampers to that portion of the combustion chamber which is in the area of the divergent flame front, i.e. which does not even cover the area of maximum heat release. Moreover, a dampening effect in the kHz range (3 to 9 kHz specified) fails to meet the requirements of lean combustion since the first circumferential modes of the usual annular combustion chambers, depending on their size, are in the range of 200 to 1000 kHz.

With effusion or transpiration cooling, the combustion chamber wall in its entirety must be provided with openings, as areas without cooling openings would remain uncooled. Also, with impingement cooling, the entire back of the surface intended for cooling must be appropriately accessible, which rules out the installation of dampers in the area of strong heat release.

In a broad aspect, the present invention provides a gas-turbine combustion chamber wall of the type specified above, which while being characterized by simple design and simple and cost-effective producibility, ensures good cooling and good dampening effects.

It is a particular object of the present invention to provide at least one solution to the above problems by a combination of the features described herein. Further advantageous embodiments of the present invention will become apparent from the description below.

These dampers can be designed as single-wall dampers by arranging the openings essentially perpendicularly (plus/minus 30 degrees to the surface normal) through the combustion chamber wall between the cooling rings, with the space between the combustion chamber and the combustion chamber casing acting as dampening volume.

The damper can also be provided in double-wall form if air consumption of the single-wall type is considered too high. Here, a further casing is used to separate a dampening volume on the outer side of the combustion chamber, with the axial extension of the damper casing being limited by the spacing of the cooling rings. The damper casing can be firmly connected to the combustion chamber wall on both sides (for example bolted or welded on flanges) or only on one side (at the upstream or downstream end), with or without provision of an additional seal at the slide fit of the moveable joint. Airflow through the damper is set via holes in the damper casing which throttle compressor exit air to the pressure desired in the damper. The dampening volume connects to the hot-gas flow via essentially perpendicular dampening openings which are slowly flown by the air.

Favorably, on both the single and the double-wall damper, a multitude of openings is distributed axially and laterally in the combustion chamber wall in the area between the cooling rings. It may be advantageous to use various spacings and cross-sections of openings on the circumference. The spacings and cross-sectional areas of the openings may change gradually or abruptly. The openings may have constant spacing and varying cross-section or constant cross-section and varying spacing or both.

The openings in the combustion chamber wall can be cylindrical holes or non-cylindrical openings. The non-cylindrical openings can change gradually (linearly or non-linearly) or abruptly in cross-section, for example from a small diameter to a larger diameter, or vice versa. Also, the cross-section of the openings itself need not be round. It can be oval, rectangular or star, cloverleaf or blossom-shaped.

The throttling holes in the damper casing are normally round and do not change in cross-section, but they may are also vary in spacing and diameter within the field of holes.

The dampening volume of the double-wall type may be completely empty or form a circumferential space. It can be axially and/or laterally divided by partitions into chambers with three or more corners, or the damper casing is no circumferential structure but extends circumferentially over a certain section only. The circumferential volume or the individual chambers can all or partly be filled with air-permeable material. This material can, for example, be felt or a weave of fibers from a heat-resistant material, such as metal, glass or ceramics, or an open-pore sponge of metal, ceramics or another heat-resistant material, respectively. The type and properties of the filler material may be similar or dissimilar throughout the dampening volume or chambers, respectively.

To reduce the air consumed by both types of acoustic damper, the application can be restricted to the wall segments (part between two cooling rings) located closely to the zone of maximum heat release or centrally between burner and turbine guide vane as the maximum effect is here obtained. Dimensioning of the dampers and, accordingly, the frequency band dampened by them may differ between the inner and the outer combustion chamber wall, also between upstream and downstream sections of the combustion chamber confined by cooling rings, as well as circumferentially within a combustion chamber segment.

In order to increase their heat resistance, the combustion chamber wall as well as the damper casing can be made of ceramics or CMC (ceramic matrix composite) instead of metal, with no need to manufacture both items in similar material.

If pure film cooling in the area of the dampers should not be sufficient, effusion cooling holes oriented at a shallow angle to the surface, for example 20 to 30 degrees, can be added between the dampening openings, which essentially extend perpendicularly through the wall (at an angle of 90 degrees), with these effusion cooling holes being supplied from the same pressure level as the dampening holes. Outside of the film cooling segments with acoustic dampers, cooling can be improved by again providing, at a shallow angle to the surface, effusion holes between the cooling rings or at the end of the combustion chamber towards the turbine.

In order to reduce the temperature of the combustion chamber wall, a ceramic heat insulation layer can be applied between the cooling rings (combustion chamber segments).

Since the dampening holes are no longer used for providing a cooling effect (for which they are suitable to a very limited extent only), the cross-section of the dampening holes can be adjusted such to the thickness of the combustion chamber wall and the dampening volume or to the distance of the combustion chamber wall to the combustion chamber casing or to the damper casing, respectively, that a substantial dampening effect is achieved also at frequencies below one kHz. With the two-skin design, further adjustability is provided via the pressure in the damper casing and, thus, via control of the flow rate in the dampening holes.

Change of the spacing or the diameter of the dampening holes enables different frequencies to be dampened. Abrupt changes in the hole arrangement provide for further dampening effects.

On both variants, the use of non-cylindrical openings enables the dampening effect to be optimized while limiting air consumption, this being due to the fact that a small cross-section on the inflow side will result in a small airflow. On both variants, elongation of the border line of the cross-section from round via angular to star, cloverleaf or blossom-shaped, respectively, enables the dampening effect to be further enhanced, with constant effective flow area (and thus constant air consumption) but with increased manufacturing costs.

The high pressure difference across the cooling-air holes produces a cooling film which is very robust against the swirl of the lean burner and optimally protects the dampening holes against ingress of hot gas. In the axial position of maximum heat release in the combustion chamber, acoustic dampers with acoustically optimized flow can now be used which are adjusted to the dampening of frequencies below 1 kHz, for example to the frequency range of 300 to 1000 Hz.

A subdivision of the damper interspace in axial and lateral direction serves to avoid compensation flows in the damper casing. Provision of air-permeable material in the dampening volume can enhance dampening.

The above-described degrees of freedom in the design of the damper enable adequate dampening of all critical frequencies to be achieved. By appropriate distribution of the air between film and effusion cooling, optimum cooling and, thus, long service life of the combustion chamber are achieved.

Figure 3:
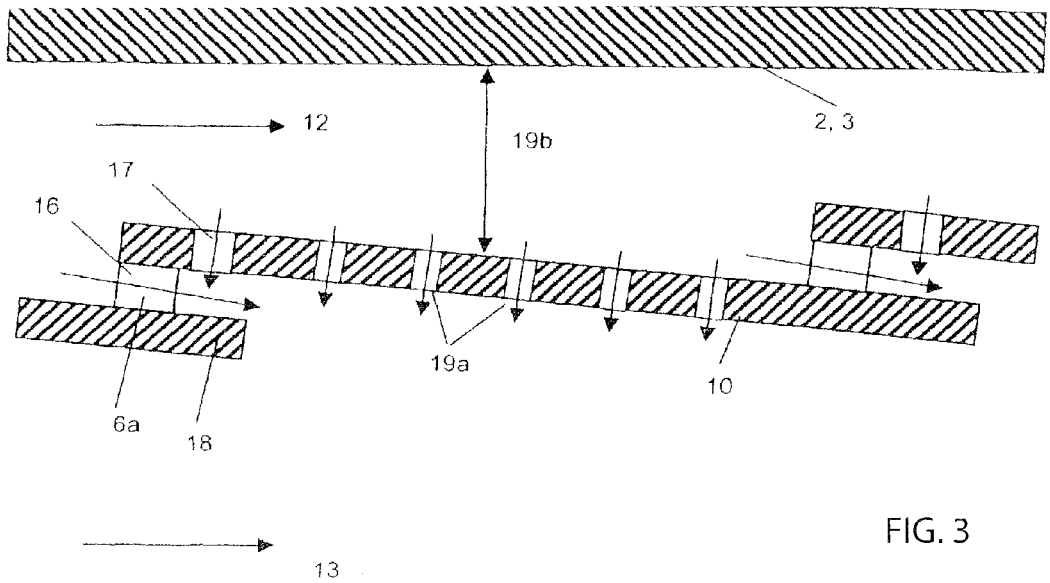
Figure 4:
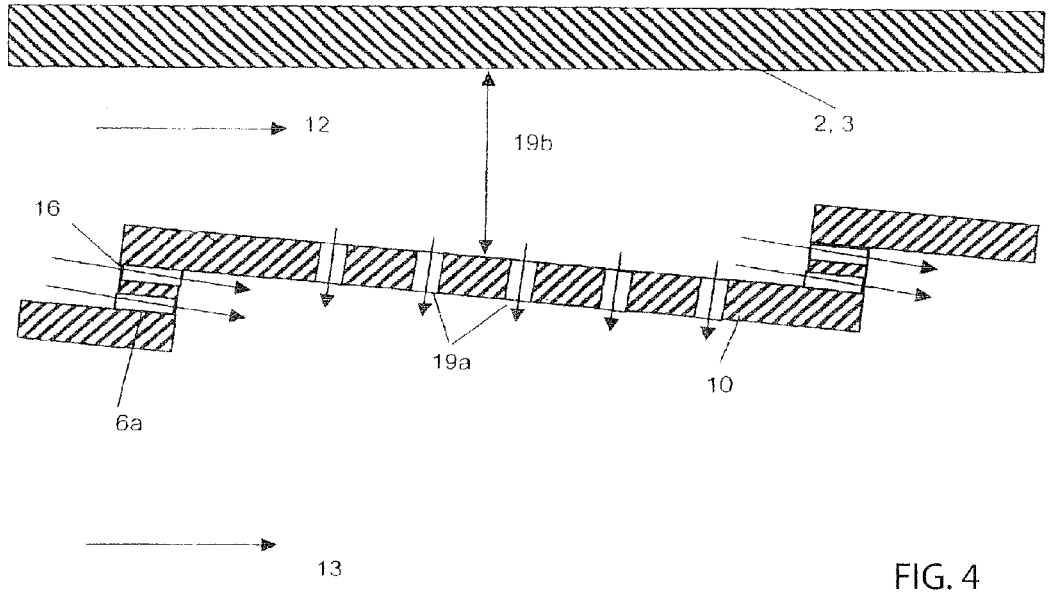
Figure 5:
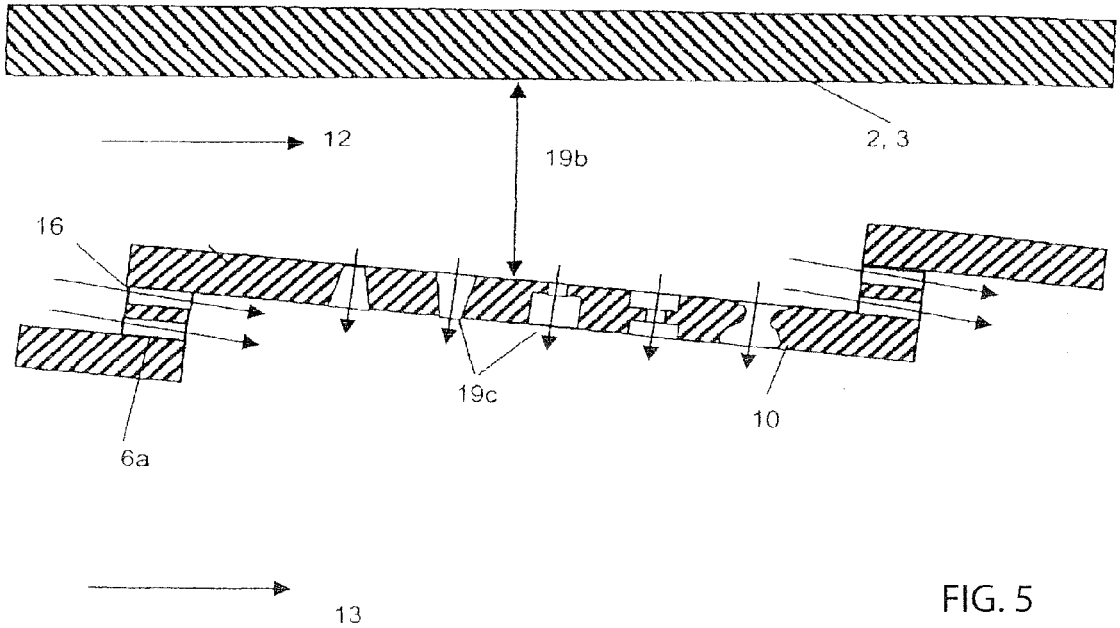
Figure 6:
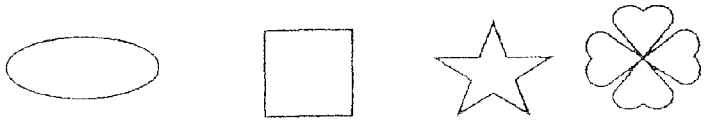
Figure 7:
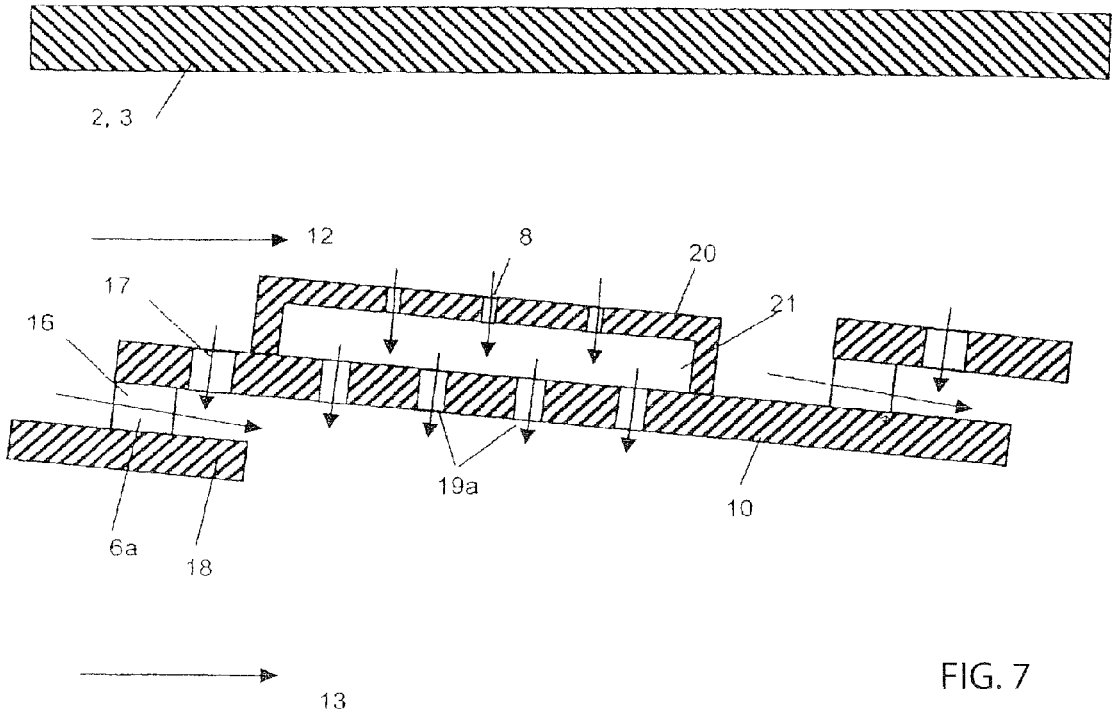
Figure 8:
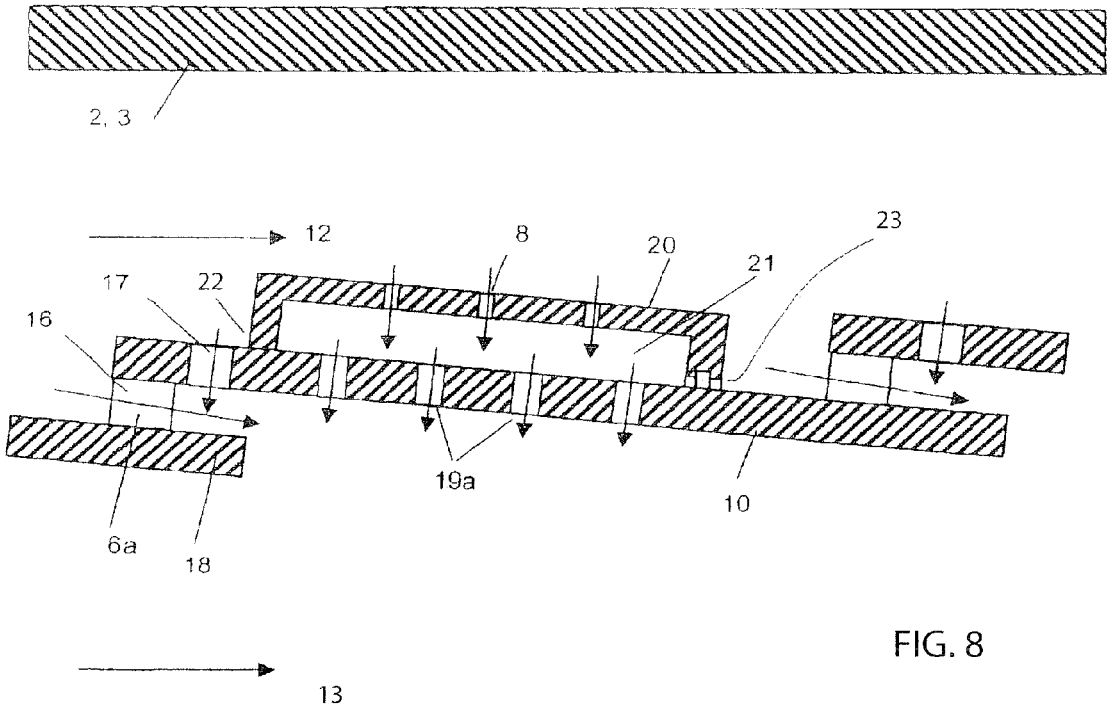
Figure 9:
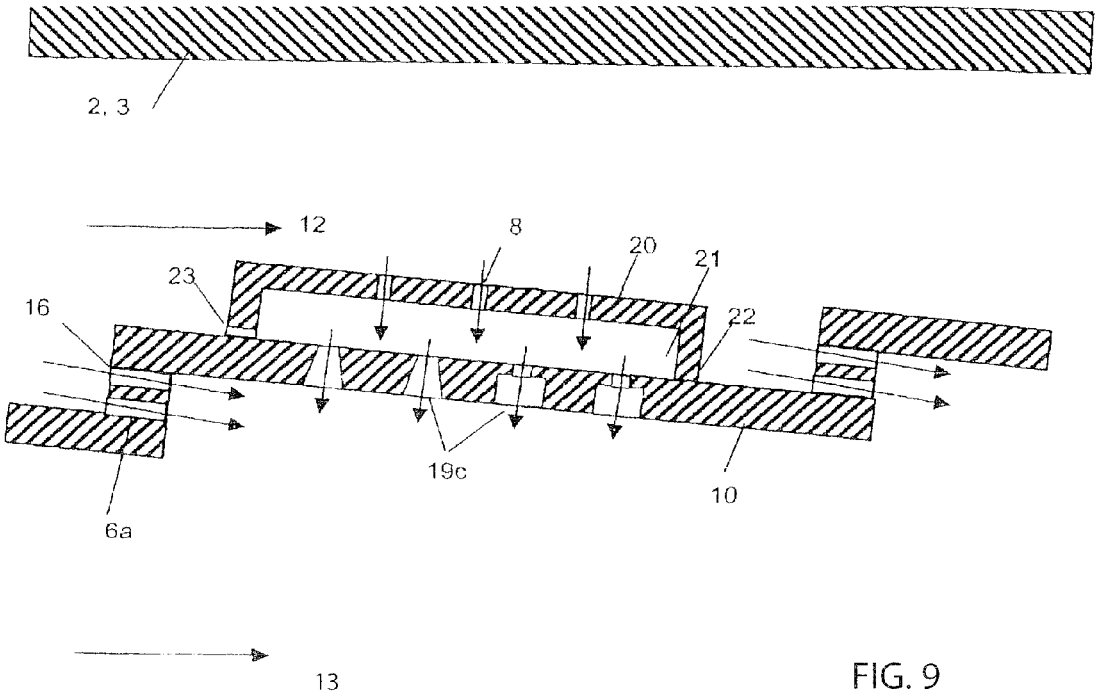
Figure 10:
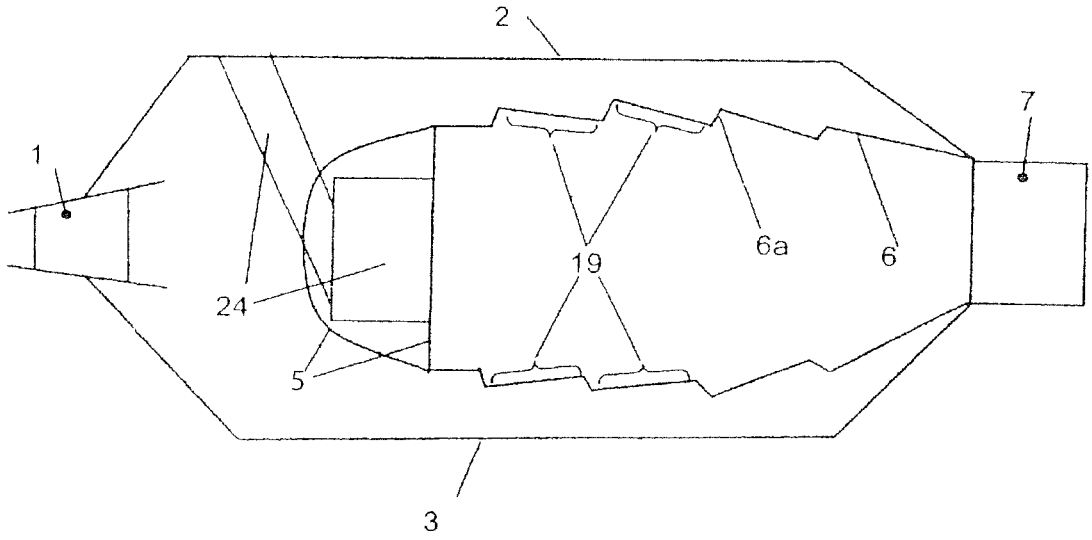
Figure 11:
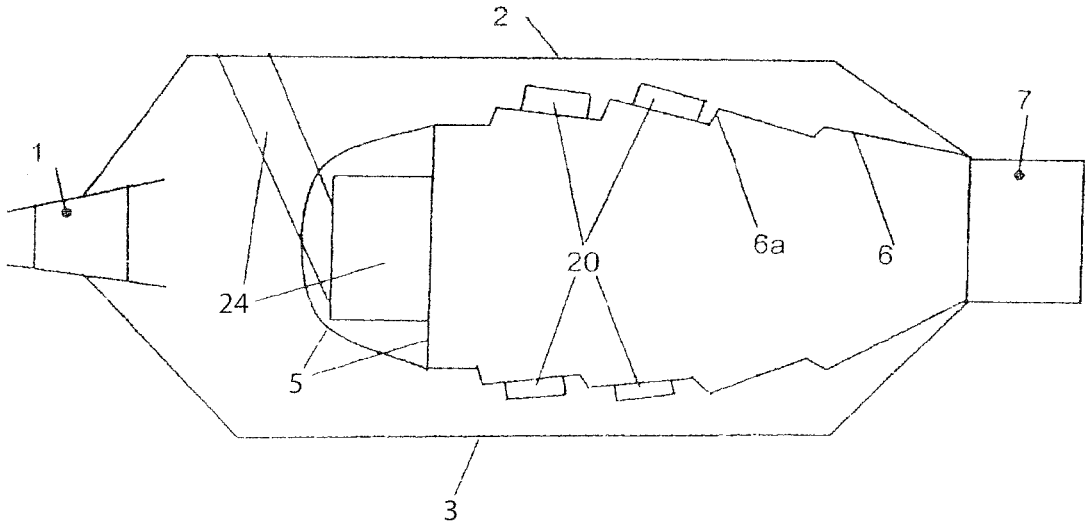

The present invention is more fully described in light of the accompanying drawings showing preferred embodiments. In the drawings, FIG. 1 is a schematic representation of a gas turbine with a gas turbine combustion chamber in accordance with the state of the art, FIG. 2 is a schematic representation of the combustion chamber casing as well as of the damper wall and the combustion chamber wall in accordance with the state of the art, FIG. 3 is a schematic representation of a first embodiment, analogically to the representation of FIG. 2, FIG. 4 is a schematic representation of a second embodiment, analogically to FIG. 3, FIG. 5 is another schematic representation of a further embodiment, FIG. 6 shows forms of representation of different cross-sections of damper openings, FIG. 7 is a schematic representation of a further embodiment with double-skin design of the combustion chamber wall, FIG. 8 is another embodiment, analogically to FIG. 7, FIG. 9 is another embodiment, analogically to FIGS. 7 and 8, FIG. 10 is a schematic representation of a gas turbine combustion chamber, analogically to FIG. 1 with arrangement of the combustion chamber segments in single-skin design, and FIG. 11 is a schematic representation, analogically to FIG. 10 with arrangement of the combustion chamber segments in double-skin design.

In the embodiments shown, identical parts are identified by the same reference numerals.

FIG. 1 schematically shows a cross-section of a gas-turbine combustion chamber according to the state of the art. Here, compressor exit vanes 1, a combustion chamber outer casing 2 and a combustion chamber inner casing 3 are shown in schematic representation. Reference numeral 4 indicates a burner with arm and head (diffusion flame). A combustion chamber head 5 is associated with a combustion chamber wall 6 with cooling rings 6*a*. Turbine inlet vanes are designated with the reference numeral 7.

Figure 2:
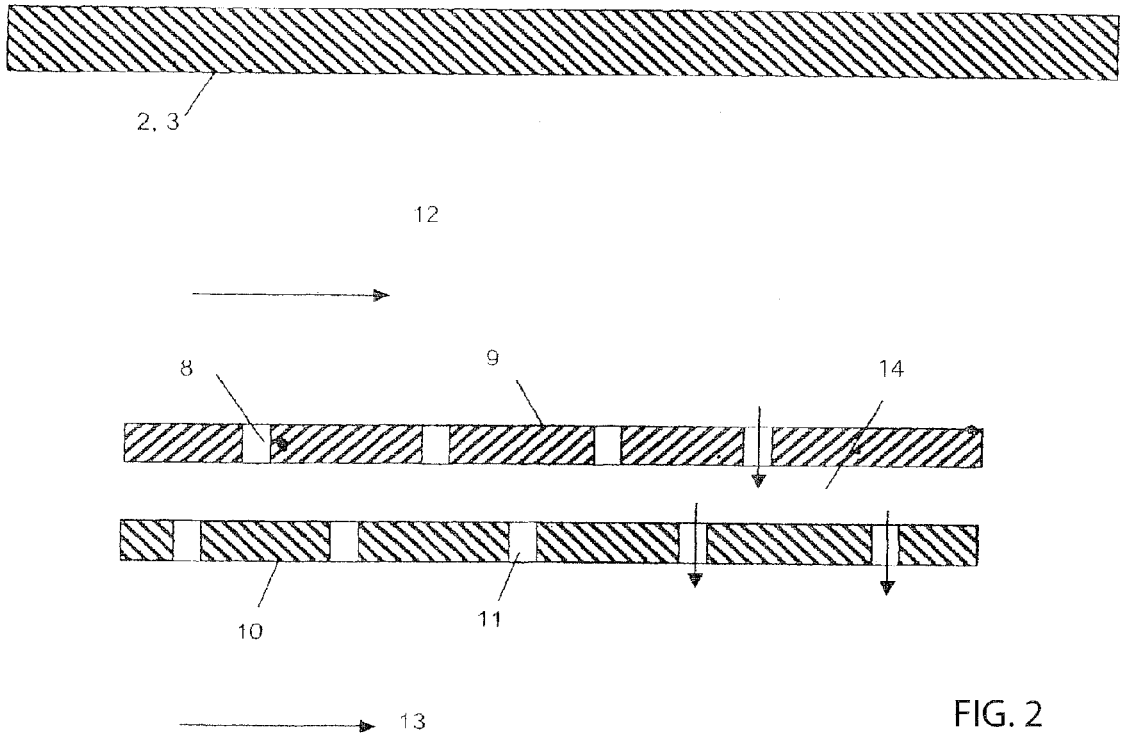
FIG. 2 (Prior Art)

FIG. 2 schematically shows, in detail view, a damper in accordance with the state of the art, with a combustion chamber wall 10 being provided with dampening and cooling holes 11 of which each extends perpendicularly to the combustion chamber wall 10. The compressor exit air is designated with reference numeral 12, while the flame and the smoke gas from the lean burner are indicated by the arrowhead 13. Disposed between damper wall 9 and combustion chamber wall 10 is a damper interspace 14. Cooling air is supplied into this damper interspace 14 via supply holes 8.

In the embodiment shown in FIG. 3, the individual combustion chamber segments, which form a single-skin combustion chamber wall, are slightly inclined towards the longitudinal axis, resulting in a tile-style, offset design. A laminar inflow of compressor exit air 12 is provided via essentially axial cooling holes 16. In addition, essentially radial cooling holes 17 can be provided. The respective fore combustion chamber segment is provided with a lip 18 on the cooling ring.

For dampening, air is introduced via additional dampening openings 19*a*, with the dampening volume being formed by the distance 19*b* to the casing 2 or 3.

The embodiment in FIG. 4 differs in that no radial cooling holes 17 are provided, but several rows of essentially axial cooling holes 16 are disposed in radially staggered arrangement.

The embodiment in FIG. 5 (in connection with the variants of FIG. 6) shows non-cylindrical dampening openings which can have the greatest variety of cross-sections along their axial length as well as altogether.

The embodiments of FIGS. 7 to 9 each show a double-skin design of the combustion chamber wall. Here, a damper casing 20 is additionally provided which encloses a dampening volume 21. The dampening volume 21 can be circumferentially subdivided and/or provided with additional filler material (see above). The embodiments in FIGS. 8 and 9 each show that one end of the damper casing is firmly attached (22), while the other area has a sliding or slideable joint 23. This enables thermal longitudinal expansion to be compensated.

FIGS. 10 and 11 show two embodiments with single and double-skin design, with the dampers being arranged closely to the heat release zone of the combustion chamber.

List of reference numerals

| | |
|---|---|
| 1 | Compressor exit vanes |
| 2 | Combustion chamber outer casing |
| 3 | Combustion chamber inner casing |
| 4 | Burner with arm and head (diffusion flame) |
| 5 | Combustion chamber head |
| 6 | Combustion chamber wall with cooling rings 6a |
| 7 | Turbine inlet vanes |
| 8 | Supply hole |
| 9 | Damper wall |
| 10 | Combustion chamber wall |
| 11 | Dampening and cooling holes |
| 12 | Compressor exit air |
| 13 | Flame and smoke gas from lean burner |
| 14 | Damper interspace between damper wall 9 and combustion chamber wall 10 |
| 15 | — |
| 16 | Essentially axial cooling holes |
| 17 | Essentially radial cooling holes |
| 18 | Lip on cooling ring |
| 19a | Dampening openings |
| 19b | Damper space |
| 19c | Non-cylindrical dampening openings |
| 20 | Damper casing between two cooling rings |
| 21 | Dampening volume (circumferentially subdivided, if necessary) |
| 22 | Firm attachment (e.g. welded or bolted flange) |
| 23 | Slideable joint (sliding seat with or without sealing) |
| 24 | Lean burner |

What is claimed is:

1. A gas-turbine combustion chamber wall for a lean-burning gas-turbine combustion chamber, comprising:

a combustion chamber casing;

several combustion chamber segments arranged in the combustion chamber casing and forming a combustion chamber wall, each of the combustion chamber segments being supplied with cooling air with film cooling via at least one of axial cooling holes and radial cooling holes, with the cooling holes being axially spaced from each other; and dampening openings being provided in the combustion chamber wall for the introduction of air;

wherein the combustion chamber segments are of a double-wall design and at least one includes a damper casing arranged radially outward and forming a circumferential dampening volume;

wherein one end of the damper casing is firmly attached to the combustion chamber segment and an other end is slideably connected to the combustion chamber segment.

2. A gas-turbine combustion chamber wall in accordance with claim 1, wherein each of the combustion chamber segments is annular and conical.

3. A gas-turbine combustion chamber wall in accordance with claim 2, wherein the combustion chamber segments overlap each other in their edge zones.

4. A gas-turbine combustion chamber wall in accordance with claim 3, wherein the combustion chamber segments are arranged closely to a zone of maximum heat release of the gas turbine combustion chamber.

5. A gas-turbine combustion chamber wall in accordance with claim 3, wherein the combustion chamber segments are arranged centrally between burners and turbine inlet vanes.

6. A gas-turbine combustion chamber wall in accordance with claim 1, wherein the circumferential dampening volume of the damper casing is at least partly filled with air-permeable material.

7. A gas-turbine combustion chamber wall in accordance with claim 1, wherein the combustion chamber wall is made of metal.

8. A gas-turbine combustion chamber wall in accordance with claim 1, wherein the combustion chamber wall is made of ceramics.

9. A gas-turbine combustion chamber wall in accordance with claim 1, wherein the combustion chamber wall is made of CMC.

10. A gas-turbine combustion chamber wall in accordance with claim 1, and further comprising effusion cooling holes arranged between the dampening openings, which essentially extend perpendicularly through the combustion chamber wall, with the effusion cooling holes being oriented at a shallow angle to a surface of the combustion chamber wall.

11. A gas-turbine combustion chamber wall in accordance with claim 1, wherein the combustion chamber segments overlap each other in their edge zones.

12. A gas-turbine combustion chamber wall in accordance with claim 1, wherein the combustion chamber segments are arranged closely to a zone of maximum heat release of the gas turbine combustion chamber.

13. A gas-turbine combustion chamber wall for a lean-burning gas-turbine combustion chamber, comprising:

a combustion chamber casing;

several combustion chamber segments arranged in the combustion chamber casing and forming a combustion chamber wall, each of the combustion chamber segments being supplied with cooling air with film cooling via at least one of axial cooling holes and radial cooling holes, with the cooling holes being axially spaced from each other; and dampening openings being provided in the combustion chamber wall for the introduction of air;

wherein the combustion chamber segments are of a double-wall design and at least one includes a damper casing arranged radially outward and forming a circumferential dampening volume, wherein the circumferential dampening volume of the damper casing is subdivided into individual chambers.

14. A gas-turbine combustion chamber wall in accordance with claim 13, wherein each of the combustion chamber segments is annular and conical.

15. A gas-turbine combustion chamber wall in accordance with claim 14, wherein the combustion chamber segments overlap each other in their edge zones.

16. A gas-turbine combustion chamber wall in accordance with claim 15, wherein the combustion chamber segments are arranged closely to a zone of maximum heat release of the gas turbine combustion chamber.

17. A gas-turbine combustion chamber wall in accordance with claim 16, wherein the combustion chamber segments are arranged centrally between burners and turbine inlet vanes.

18. A gas-turbine combustion chamber wall in accordance with claim 13, wherein the circumferential dampening volume of the damper casing is at least partly filled with air-permeable material.

19. A gas-turbine combustion chamber wall in accordance with claim 13, wherein the combustion chamber wall is made of metal.

20. A gas-turbine combustion chamber wall in accordance with claim 13, wherein the combustion chamber wall is made of ceramics.

* * * * *